US006742950B1

(12) United States Patent
Coombs

(10) Patent No.: US 6,742,950 B1
(45) Date of Patent: Jun. 1, 2004

(54) METHOD OF FLUID APPLICATION AND APPLICATOR ASSEMBLY THEREFOR

(76) Inventor: Gregory A. Coombs, 403-1868 W. 5th Avenue, Vancouver B.C. (CA), V6J 1P3

( * ) Notice: Subject to any disclaimer, the term of this patent is extended or adjusted under 35 U.S.C. 154(b) by 43 days.

(21) Appl. No.: 10/302,705

(22) Filed: Nov. 25, 2002

(51) Int. Cl.[7] ..... A47L 1/08; A47L 13/12

(52) U.S. Cl. ..... 401/23; 401/6; 401/25; 401/183; 401/197; 401/202; 401/208

(58) Field of Search ..... 401/6, 16, 21, 401/23, 25, 36, 183–185, 196, 197, 202, 208, 282, 284, 289; 118/258, 264; 15/105

(56) References Cited

U.S. PATENT DOCUMENTS 4,555,196 A 11/1985 De Garmo
4,571,769 A 2/1986 Ford
5,176,754 A * 1/1993 Hirzel ..... 118/258
5,419,646 A 5/1995 Taylor
5,564,851 A * 10/1996 Connelly et al. ..... 401/197
6,017,162 A * 1/2000 Call ..... 401/6
6,129,469 A * 10/2000 Messer et al. ..... 401/6
6,412,997 B2 * 7/2002 Berke et al. ..... 401/6

* cited by examiner

*Primary Examiner*—Tuan N. Nguyen
(74) *Attorney, Agent, or Firm*—Frederick Kaufman

(57) ABSTRACT

An applicator assembly comprises a flexible reservoir, to which are joined a pair of applicators. The latter includes a first and second applicators. The first applicator has its longitudinal axis of symmetry perpendicularly disposed relative to the flexible reservoir, respectively to its longitudinal axis, while the second applicator is coaxial with the flexible reservoir. The first and second applicators are located at opposite ends of the flexible reservoir. An arm connects the first applicator to the flexible reservoir. A pair of protective covers including a first and second protective covers is intended to slip over the pair of applicators, respectively the first and second applicators. A valve is incorporated into the flexible reservoir, so as to resist passage of a fluid contained in the latter, while letting the atmospheric air to infiltrate therein.

5 Claims, 5 Drawing Sheets

METHOD OF FLUID APPLICATION AND APPLICATOR ASSEMBLY THEREFOR

I. BACKGROUND OF THE INVENTION

1. Field of the Invention

This invention relates to a method of fluid application and applicator assembly thereof, adapted for self-application of cosmetic and/or pharmaceutical lotions, such as suntan lotion, to the skin, especially but not only normally-inaccessible skin-areas. Obviously, the aforementioned method and applicator have been also devised, having in mind, other possible uses.

2. Description of the Prior Art

Now it is already recognized that long exposure to sunlight leads to dangerous consequences.

It is, therefore, a high priority requirement to apply suntan lotion to all skin-areas likely to be affected. There are, however, skin-areas that are difficult to reach, e.g. the upper part of the back of a sunbather, such as the zone between the shoulder blades. Attempts have been previously made to overcome this drawback. U.S. Pat. No. 6,017,162, dated Jan. 25, 2000 and granted to Call for a "Lotion Dispensing System", discloses a lotion applicator having a handle and a housing at a bottom end of the handle, the latter incorporating therein a reservoir for holding lotion. An applicator roller assembly is provided. There are two disadvantages to this applicator design. First, the reservoir is of gravitational type, which, in use, impliedly requires positioning the reservoir above the applicator roller assembly. Second, controlling the quantity of dispensed lotion by exerting a variable pressure on the reservoir is not possible. U.S. Pat. No. 5,564,851, dated Oct. 15, 1996 and granted to Connelly et al. for a "Roller Applicator for Distributing Preparation to the Skin" describes a roller applicator device and method for distributing preparations to hard to reach body parts. The device comprises a roller portion for storing and distributing a preparation and a detachable and extendable handle portion. The roller portion includes a canister with a receptacle for attaching the handle. The canister is provided with a plurality of apertures and a porous layer is disposed around the canister. There are several shortcomings to this device. First, the problem of the preparation seepage, during use and storage of the roller portion including a canister, especially in the case of low viscosity preparations, is not addressed. Second, no positive control of the dispensed preparation is contemplated. Third, the canister requires a permanent sealing. U.S. Pat. No. 5,176,754, dated Jan. 5, 1993 and granted to Hirzel for an "Apparatus with Double Applicator Means" describes a hand held coating apparatus comprising handle provided at both ends with an applicator. One of the applicators is rotatable and the other is stationary. Hirzel structure has three essential disadvantages. First, no reservoir is included. Second, no means is provided for preventing the dripping of the lotion from the applicator that is not in use. Third, it is difficult to maintain the cleanness of the apparatus.

II. SUMMARY OF THE INVENTION

There is accordingly, in view of the foregoing disadvantages inherent in the known types of lotion applicators now present in the prior art, a need for a new method of application of a fluid and an improved applicator assembly therefor.

In its broadest content, the applicator assembly comprises a flexible reservoir, to which are joined a pair of applicators.

The latter includes a first and second applicators. The first applicator has its longitudinal axis of symmetry perpendicularly disposed relative to the flexible reservoir, respectively to its longitudinal axis, while the second applicator is coaxial with the flexible reservoir. The first and second applicators are located at opposite ends of the flexible reservoir. An arm connects the first applicator to the flexible reservoir so, as stated before, the longitudinal axis of symmetry of the first applicator is perpendicular to the longitudinal axis of the flexible reservoir. Pair of protective covers including a first and second protective covers are intended to envelop the pair of applicators, respectively the first and second applicators. A valve is incorporated into the flexible reservoir, so as to resist passage of a fluid contained in the latter, while allowing the atmospheric air to infiltrate therein.

In one aspect of this invention, the flexible reservoir has a main body incorporating at one end, opposite to the arm, a first cylindrical portion of lesser diameter than the main body, followed by a second cylindrical portion, which is of lesser diameter than the first cylindrical portion and has external threads. An intermediary feature having a basis from which extend, with respect to the main body, cylindrical inward and outward sections. The basis is attached to the second cylindrical portion by internal threads provided on said inward section, the internal threads engaging the external threads. The basis also incorporates an axial cylindrical opening, parallel to the longitudinal axis, and terminating outwardly with a circular recess, of larger diameter than the axial cylindrical opening, which serves as a stopper for the valve. A body of the latter penetrates into the main body. The basis incorporates as well a radial passage starting outside the circular recess and communicating with the exterior of the intermediary feature. Thus, a communication between the interior of the flexible reservoir adapted to contain a fluid and the environment is established.

In another aspect of this invention, the flexible reservoir and the arm are made as a single piece.

In yet another aspect of this invention, the valve is of one-way type, has an air path extending therethrough and is defined partially by a pair of spaced opposed wall surfaces inclined towards each other. The spaced opposed wall surfaces meet so, that they lie flat against each other establishing a contact zone while still allowing the air path therebetween. At an other end opposed to the pair of opposed wall surfaces, the valve has an opening for the air path, surrounded by a peripheral flange.

Broadly described, a method of applying a fluid, using the above described applicator assembly, comprises the following operations:

- removing one of the pair of protective covers; then
- squeezing the flexile reservoir to expel a quantity of fluid contained within; and simultaneously
- dispensing the one of the applicators which has its protective cover removed;
- preventing the exit of fluid from the flexible reservoir during the previous two operations by using said valve;
- terminating the above operation of squeezing the flexible reservoir, which takes place simultaneously with the following operation of
- infiltrating of atmospheric air through the valve into the flexible reservoir; and finally
- replacing the one protective cover that was removed in the first operation.

III. BRIEF DESCRIPTION OF THE DRAWINGS

Although the characteristic features of this invention will be pointed out in the claims, the invention itself, and the manner in which it may be made and used, may be better understood by referring to the following description taken in connection with the accompanying drawings forming part hereof, wherein like reference numerals refer to like parts throughout the several views in which:

IV. DESCRIPTION OF THE PREFFERED EMBODIMENTS

Figure 1:
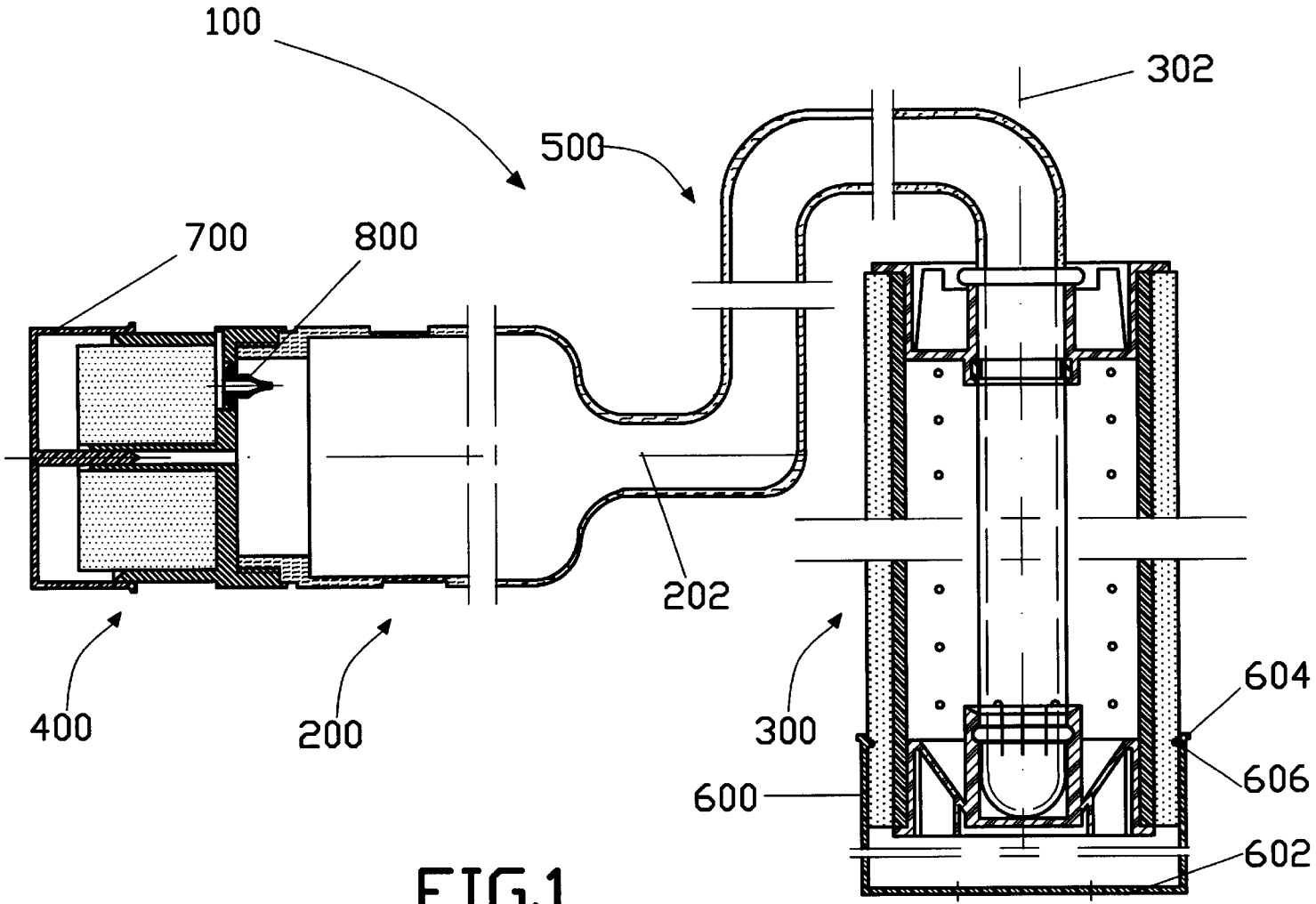
FIG. 1 is a longitudinal section of an applicator assembly according to the present invention.

Referring now to the drawings, an applicator 100, broadly described, comprises a flexible reservoir 200 to which are joined a pair of applicators: a first and second applicator 300 and 400, respectively. First applicator 300 has its longitudinal axis of symmetry 302 perpendicularly disposed relative to flexible reservoir 200, respectively to its longitudinal axis 202, while second applicator 400 is coaxial with flexible reservoir 200. First and second applicator 300 and 400 are located, respectively, at opposite extremities of flexible reservoir 200.

An arm 500 connects first applicator 300 to flexible reservoir 200 so that, as stated before, longitudinal axis of symmetry 302 of first applicator 300 is perpendicular to longitudinal axis 202 of flexible reservoir 200.

A pair of protective covers: a first and second protective cover 600 and 700 are used to envelop the pair of applicators, respectively first and second applicators 300 and 400. Thus, first protective cover 600 is removable attached over first applicator 300 to envelop the latter when required, while second protective cover 700 is removable attached over second applicator 400 to envelop the latter when required.

Furthermore, applicator assembly 100 includes a valve 800.

Valve 800 is attached to flexible reservoir 200 so, as to resist passage of a fluid contained in the latter, in an opposite direction of airflow from outside flexible reservoir 200.

For use of applicator assembly 100, selectively, one of the pair of protective covers: first or second protective cover 600 or 700, respectively, is detached from one of the pair of applicators: first or second applicator 300 or 400, respectively, and then flexible reservoir 200 is squeezed. A squeeze on flexible reservoir 200 creates a pressure enabling the fluid to be expelled through only one of said pair of applicators: first or second applicator 300 or 400, respectively (that which has its protective cover, respectively first or second protective cover 600 or 700, removed).

In the following preferred embodiment, applicator assembly 100 is intended for health and cosmetics, for example sun-tanning lotions or oils.

Figure 8:
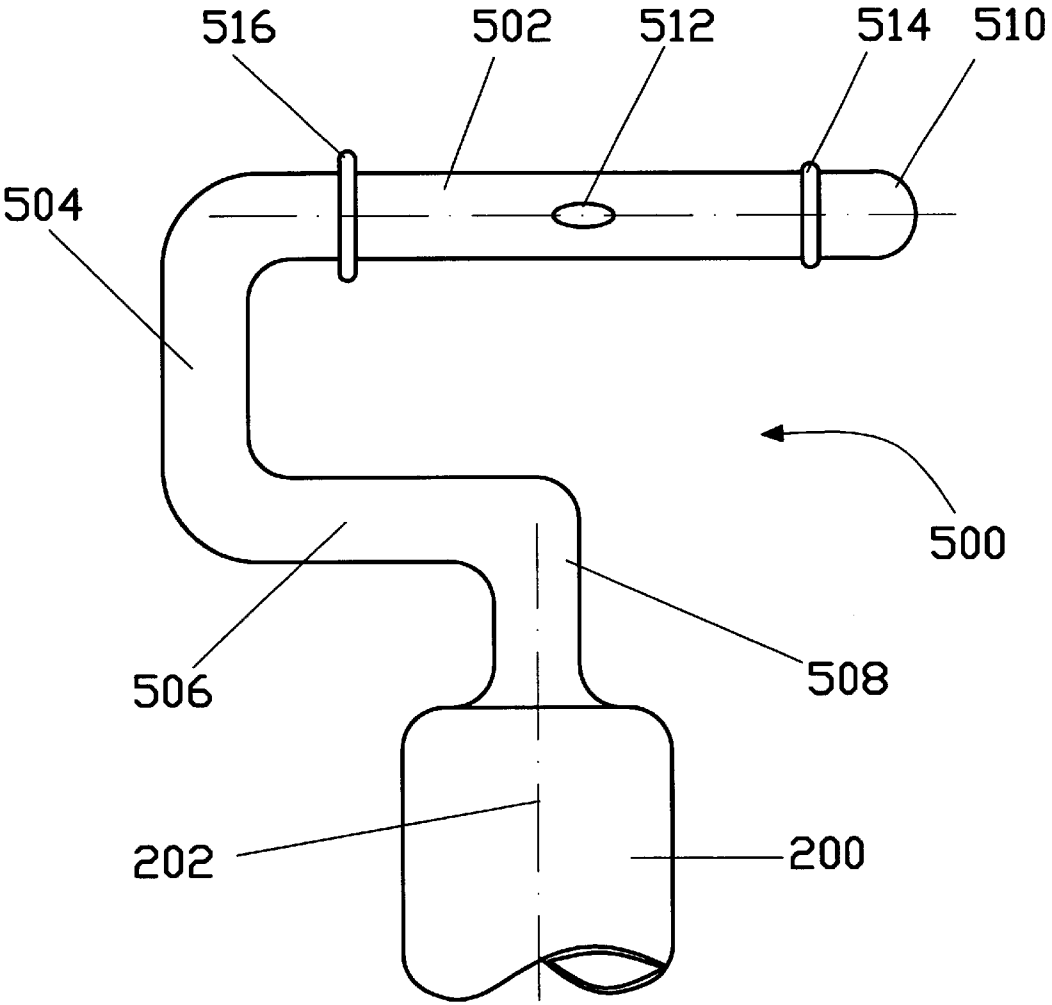
FIG. 8 is a front elevation view of an arm together with a portion of a reservoir.

Flexible reservoir 200 and arm 500 are shown in FIG. 8 made as a single piece, but it may be envisaged, in an alternative variant, that they may be formed separately and assembled together. Applicator assembly 100 may be disposable or reusable, entirely or partially. Flexible reservoir 200 and arm 500 may be made from synthetic polymer composition material, compatible with the chemical characteristics of the fluid stored therein.

Furthermore, besides the material, it is also important to note that the thickness of the walls of flexible reservoir 200 should be lesser than the thickness of the walls of arm 500, so that flexible reservoir 200 is rendered structurally resilient. In the present embodiment, flexible reservoir 200 has a hollow cylindrical form, defined by a circular cross-section. Flexible reservoir 200 having polygonal, elliptic or other cross-sections can also be envisaged.

Figure 2:
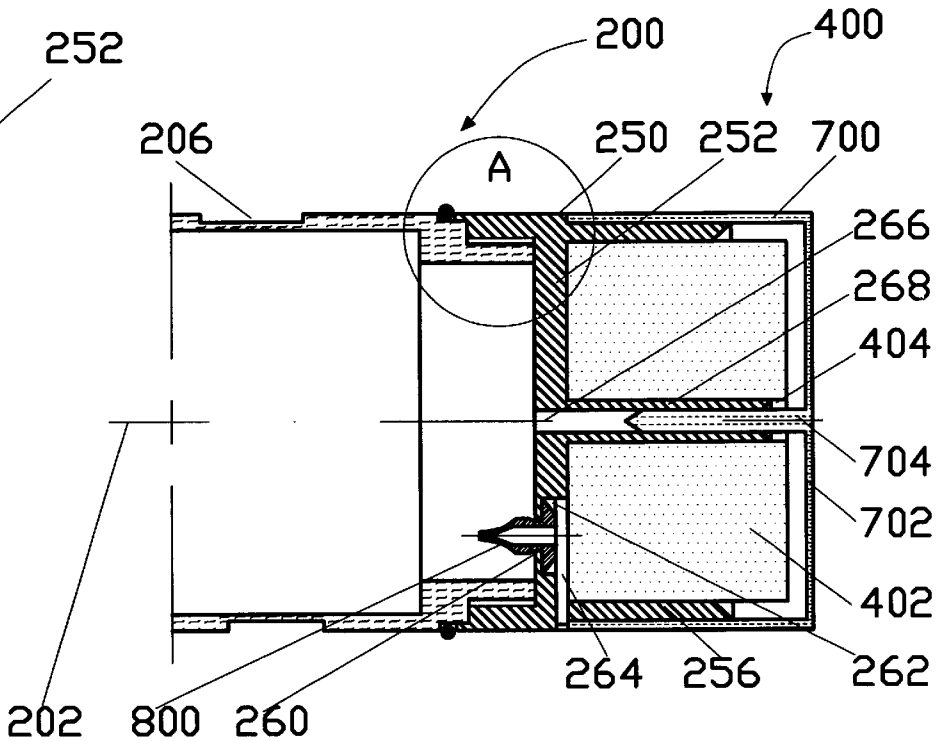
FIG. 2 is an enlarged longitudinal section of a partially depicted reservoir together with a second applicator and an intermediary feature.
Figure 3:
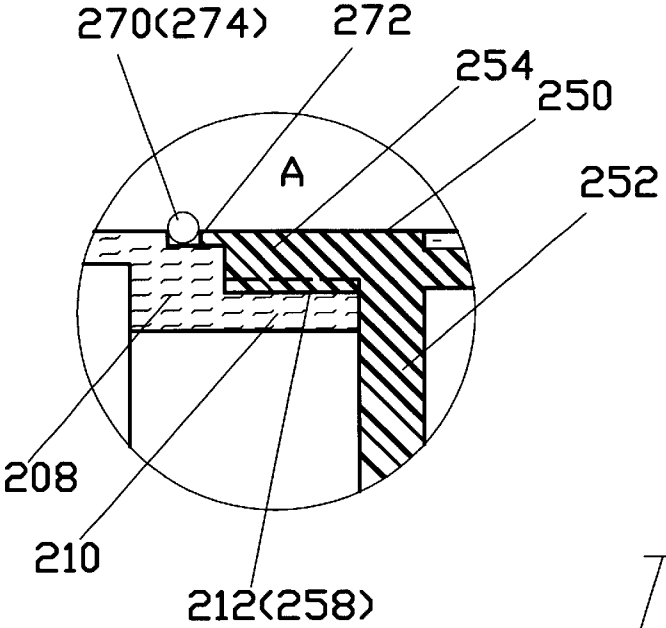
FIG. 3 is an enlarged view of fragment A of FIG. 2.
Figures 4, 5, 6:
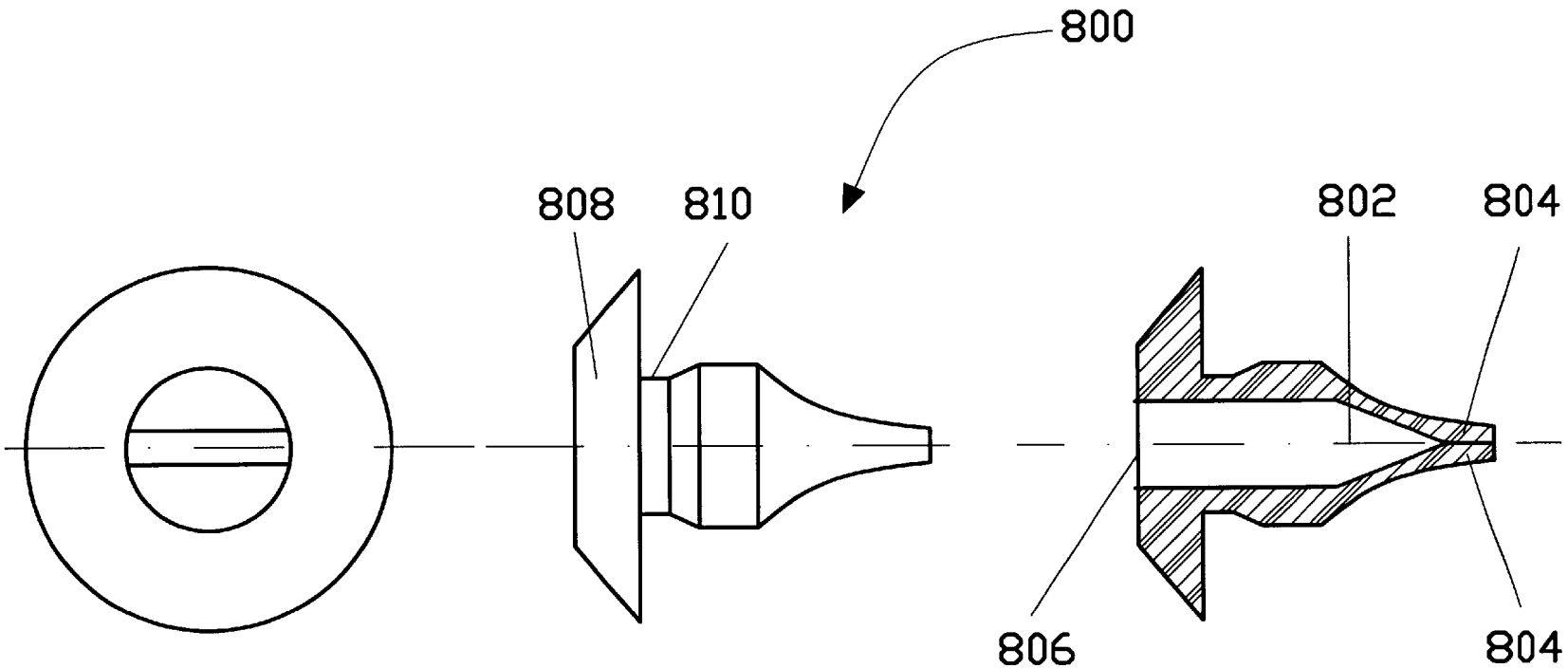
FIG. 4 is a front elevation of a valve used in the present invention.
FIG. 5 is a longitudinal section of the valve depicted in FIG. 3.
FIG. 6 is a right side view of the valve depicted in FIGS. 3 and 4.
Figure 7:
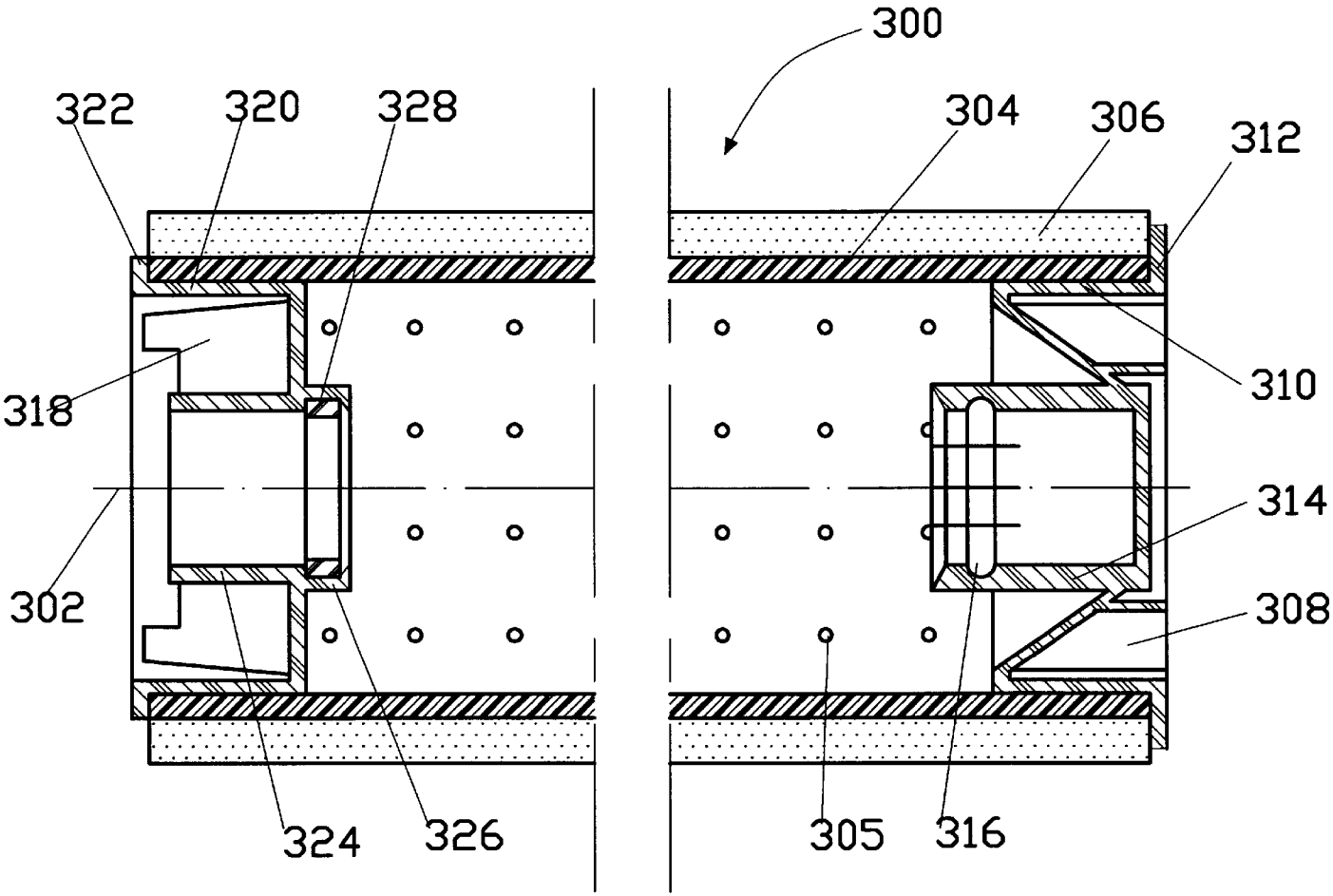
FIG. 7 is enlarged longitudinal section of a first applicator.

Flexible reservoir 200 (see FIGS. 2 and 3) is provided on it's exterior with recessed zones 206 for thumb and finger grip, and incorporates at one end, opposite to arm 500, a first cylindrical portion 208 of lesser diameter than flexible reservoir 200. A second cylindrical portion 210, which follows first cylindrical portion 208, is of a lesser diameter than the latter and is provided with external threads 212.

An intermediary feature 250 having a basis 252 from which extend, with respect to flexible reservoir 200, cylindrical inward and outward sections 254 and 256, respectively, is attached to second cylindrical portion 210 by means of internal threads 258 provided on inward section 254. Basis 252 incorporates an axial cylindrical opening 260, which is parallel to longitudinal axis 202, and extends outwardly into a circular recess 262 of larger diameter than axial cylindrical opening 260. Circular recess 262 serves as a stop for valve 800. The body of the latter penetrates into flexible reservoir 200. Basis 252 incorporates as well a radial passage 264 that starts outside circular recess 262 and communicates with the exterior of intermediary feature 250. Thus, a communication between the interior of flexible reservoir 200 containing sun-tanning lotion and the environment is established. Basis 252 includes a central discharge orifice 266 from which a tube 268 extends in a direction outwardly from flexible reservoir 200.

Valve 800 of one-way type is inserted into axial cylindrical opening 260 and allows for passage of air therethrough, while minimizing the likelihood of fluid flowing back out through axial cylindrical opening 260. Valve 800 has an air path 802 extending therethrough that is defined partially by a pair of spaced opposed wall surfaces 804 inclined towards each other. The pair of spaced opposed wall surfaces 804 meet to lie flat against each other whilst still allowing an air path therebetween. A contact zone established between the pair of spaced opposed wall surfaces 804 has a length in the range between 0.3 mm and 0.5 mm along the direction of air path 802.

Valve 800, at the other end opposed to the pair of spaced opposed wall surfaces 804, has an opening 806 to air path 802 surrounded by a peripheral flange 808. Beneath the latter, valve 800 has a circular recess 810 for snugly locating in axial cylindrical opening 260. Valve 800 is molded from a thermo-plastic rubber compound and has a Shore hardness in a range between 30 and 50. Valve 800 allows the passage of air under only a slight difference of pressure, while still remains effective to prevent the fluid content of flexible reservoir 200 from flowing out.

A gap 270 is formed between an inward end 272 of cylindrical inward section 254 and a step formed by a difference of diameters between flexible reservoir 200 and its first cylindrical portion 208.

A carrying ring 274 is secured by compression in gap 270.

Arm 500 has a tubular structure and forms, as stated before, a unitary construction with flexible reservoir 200. Arm 500 comprises four successive sections:

- a first applicator axle section 502, coaxial with longitudinal axis of symmetry 302 of first applicator 300;
- a joining portion 504, substantially perpendicularly extending from one end of first applicator axle portion 502;
- a bent portion 506; and
- a butted portion 508, coaxial with and extending from flexible reservoir 200. Bent portion 506 connects joining and butted portions 504 and 508, respectively.

First applicator axle portion 502 has a front closed end 510 and centrally located perforations 512. Moreover, first applicator axle portion 502 is provided on its circumference, firstly, with an annular shoulder 514, disposed near front closed end 510, and, secondly, with a stop rim 516, located proximately to an extremity of first applicator axle portion 502, which is opposite to front closed end 510.

First applicator 300 includes a core 304 having a cylindrical sleeve form with a larger diameter in comparison with the diameter of first applicator axle portion 502. Core 304 has a plurality of through holes 305 disposed throughout its periphery in a plurality of columns for discharging the suntan lotion from its internal cavity to its exterior surface. The quantity, size and arrangement of through holes 305 are established according to the viscosity and of the suntan lotion. Through holes 305 have diameters ranging from about 0.015 inch (0.0381 cm) to 0.1875 inch (0.45 cm).

Core 304 is substantially rigid and can be formed from rigid thermoplastic material. A porous cover 306 made of open-cell foam sponge, compatible with the suntan lotion, is snugly fitted or attached by known conventional means about core 304. The internal diameter of porous cover 306 should be slightly reduced in comparison with external diameter of core 304 and the length of porous cover 306 and core 304 should be commensurable. The porosity of the open-cell foam sponge can be selected such that it will release a uniform amount of suntan lotion when it is gently rubbed against the surface of the skin. The thickness and type (porosity) of porous cover 306 is dependent upon the viscosity of the suntan lotion and the quantity, size and disposition of aforementioned holes. Porous cover 306 is made from an open cell type of foam having a porosity of about 4.5 PCF and a thickness between 0.015 inch (0.0381 cm) and 0.100 inch (0.254 cm). A preferred open-cell foam sponge material is elastomeric polyurethane. By utilizing a permanently compression-set foam, the wicking and accumulating capacities of open-cell foam sponge can be selected such that the suntan lotion delivered through porous cover 306 wets open-cell sponge material but does not drip from it when it is suspended in midair facing down.

A closed end cap 308 of unitary construction has a tubular body 310 for insertion into core 304. A circular brim 312, extending outwardly at one extremity of tubular body 310, serves as a stopper in two situations: first, when closed end cap 308 is inserted into core 304 and second, when first protective cover 600 is attached over first applicator 300. A partially slotted cylinder 314 coaxial with tubular body 310 is also part of closed end cap 308 and has an internal diameter that allows a close running fit with first applicator axle section 502. Partially slotted cylinder 314 is provided with a grooved peripheral neck 316, for resiliently attaching with annular shoulder 514.

An open-end cap 318 of unitary construction has a cylindrical tubular body 320 for insertion into core 304. A brim 322 extends outwardly at one extremity of cylindrical tubular body 320 and serves as a stopper when open-end cap 318 is inserted into core 304. A cylinder 324 coaxial with cylindrical tubular body 320 is also part of open-end cap 318 and has an internal diameter that allows a close running fit with first applicator axle section 502. An inwardly extending cylinder 326, oppositely located with respect to brim 322, communicates with the interior of cylindrical tubular body 320 and has an internal diameter slightly larger than cylinder 324. A ring seal 328, having an internal diameter somewhat reduced in comparison with the diameter of first applicator axle portion 504, is inserted into inwardly extending cylinder 326 until it reaches a shoulder formed between cylinder 324 and inwardly extending cylinder 326. When first applicator 300 engages first applicator axle portion 502, its axial inward movement terminates when cylinder 324 reaches annular shoulder 516. Simultaneously, an attachment between annular shoulder 514 and grooved peripheral neck 316 is achieved.

First applicator axle portion 502 receives thereover first applicator 300 (core 304, porous cover 306, closed end cap 308 and open-end cap 318 with ring seal 328) to revolve thereabout.

First protective cover 600, preferably made of rigid thermoplastic material, has a hollow cylindrical shape with a perforated end wall 602 at one extremity and a flared end 604 at the opposed extremity. An internal circular ridge 606, formed close to flared end 604, enables first protective cover 600 to resiliently attach over circular brim 312. The internal diameter of first protective cover 600 is slightly reduced in comparison with the external diameter of porous cover 306, so that the latter is compressed and, consequently, its pores closed when first protective cover 600 envelopes first applicator 300.

Second applicator 400 consists essentially of a cylindrical sponge of porous material 402 disposed in cylindrical outward portion 256. The former has a central through channel 404 in which tube 268 is inserted. The length of the latter is somewhat reduced in comparison with the length of cylindrical sponge of porous material 402, so that tube 268 does not touch or scratch user's skin when cylindrical sponge of porous material 402 is compressed during use.

Second protective cover 700, preferably formed from rigid thermoplastic material, has a hollow cylindrical shape with a closed end wall 702 at one extremity. A tipped central stem 704 extends inwardly from closing end wall 702 into the cavity of second protective cover 700. When second protective cover 700 is attached over second applicator 400, tipped central stem 704 snugly penetrates into tube 268 and, thus, prevents the exit of suntan lotion. Furthermore, second protective cover 700 provides a sealed engagement.

Second protective cover 700 can resiliently attach off and on cylindrical outward portion 256.

Applicator assembly 100 comprises first applicator 300 for fast and evenly distributing suntan lotion. Second applicator 400 is used for applying suntan lotion in limited and difficult to reach skin surfaces.

Arm 500 together with flexible reservoir 200 should be of sufficient length extension to allow the user to handle selectively and conveniently first and second applicators 300 and 400, so as to reach usually inaccessible surfaces. On the other hand, applicator assembly 100 should not be cumbersome and inconvenient to store when not in use. In order to further facilitate dispensing of suntan lotion in otherwise-inaccessible skin-areas such as those between shoulder blades, first applicator 300 should be of a length of 2.5 to 4 inches (approx. 6.5 to 10 centimeters).

A method of applying a fluid, using the above described applicator assembly 100, comprises the following operations:

removing one of the pair of protective covers; then squeezing the flexile reservoir to expel a quantity of fluid contained within; and simultaneously dispensing the one of the applicators which has its protective cover removed;

preventing the exit of fluid from the flexible reservoir during the previous two operations by using said valve;

terminating the above operation of squeezing the flexible reservoir, which takes place simultaneously with the following operation of infiltrating of atmospheric air through the valve into the flexible reservoir; and finally replacing the one protective cover that was removed in the first operation.

As required, detailed embodiments of the present invention are disclosed herein; however, it is to be understood that the disclosed embodiments are merely exemplary of the invention, which may be embodied in various forms. Therefore, specific structural and functional details disclosed there in are not to be interpreted as limiting, but merely as a basis for the claims and as a representative basis for teaching one skilled in the art to variously employ the present invention in virtually any appropriately detailed structure.

The embodiments of the invention in which an exclusive property or privilege is claimed are defined as follows:

1. An applicator assembly, comprising in combination a flexible reservoir, to which are joined a pair of applicators including first and second applicators, said first applicator having its longitudinal axis of symmetry perpendicularly disposed relative to said flexible reservoir, respectively to its longitudinal axis, while said second applicator is coaxial with said flexible reservoir, said first and second applicators being located at opposite ends of said flexible reservoir;

an arm connecting said first applicator to said flexible reservoir so, as stated before, said longitudinal axis of symmetry of said first applicator is perpendicular to said longitudinal axis of said flexible reservoir;

a pair of protective covers including a first and second protective covers intended to envelop said pair of applicators, respectively said first and second applicators; and a valve connected to said flexible reservoir, so as to resist passage of a fluid contained in the latter, in an opposite direction of airflow from outside said flexible reservoir.

2. The applicator assembly, as defined in claim 1, where in said flexible reservoir incorporates at one end, opposite to said arm, a first cylindrical portion of lesser diameter than said main body, followed by a second cylindrical portion, which is of lesser diameter than said first cylindrical portion and has external threads; an intermediary feature having a basis from which extend, with respect to said flexible reservoir, cylindrical inward and outward sections, said basis being attached to said second cylindrical portion by internal threads provided on said inward section, said internal threads engaging said external threads, said basis also incorporating an axial cylindrical opening, parallel to said longitudinal axis and terminating outwardly with a circular recess of larger diameter than said axial cylindrical opening that serves as a stopper for said valve, a body of the latter penetrating into said main body, said basis incorporating as well a radial passage starting outside said circular recess and communicating with the exterior of said intermediary feature, whereby a communication between the interior of said flexible reservoir adapted to contain a fluid and the environment is established.

3. The applicator assembly, as defined in claim 1 or claim 2, wherein said valve is of one-way type, has an air path extending therethrough and is defined partially by a pair of spaced opposed wall surfaces inclined towards each other, said spaced opposed wall surfaces meeting so, that they lie flat against each other establishing a contact zone while still allowing said air path therebetween, at an other end opposed to said pair of opposed wall surfaces, said valve has an opening for said air path, said opening being surrounded by a peripheral flange.

4. The applicator assembly, as defined in claim 1, wherein said flexible reservoir and said arm are made as a single piece.

5. A method of fluid application, carried out by an applicator assembly including a flexible reservoir, to which are joined a pair of applicators comprising first and second applicators, said first applicator having its longitudinal axis of symmetry perpendicularly disposed relative to said flexible reservoir, respectively to its longitudinal axis, while said second applicator is coaxial with said flexible reservoir, said first and second applicators being located at opposite ends of said flexible reservoir;

an arm connecting said first applicator to said flexible reservoir so, as stated before, said longitudinal axis of symmetry of said first applicator is perpendicular to said longitudinal axis of said flexible reservoir; said second applicator extending out of said flexible reservoir;

a pair of protective covers including a first and second protective covers intended to envelop said pair of applicators, respectively said first and second applicators; and a valve incorporated into said flexible reservoir, so as to resist passage of a fluid contained in the latter, in an opposite direction of airflow from outside said flexible reservoir;

said method for fluid application comprising the following operations:

removing selectively one of said pair of protective covers; then squeezing said flexile reservoir to expel a quantity of fluid contained within; and simultaneously using for dispensing one of said pair of applicators, which has been selected above and has had its protective cover already removed;

preventing the exit of fluid from said flexible reservoir during the previous two operations by using said valve;

terminating the above operation of squeezing said flexible reservoir, which takes place simultaneously with the following operation of infiltrating of atmospheric air through said valve into said flexible reservoir; and finally replacing said one protective cover that was removed in the first operation.

* * * * *